US006498832B2

(12) United States Patent
Spence et al.

(10) Patent No.: US 6,498,832 B2
(45) Date of Patent: Dec. 24, 2002

(54) ELECTRODE CONFIGURATION FOR EXTREME-UV ELECTRICAL DISCHARGE SOURCE

(75) Inventors: Paul Andrew Spence, Pleasanton, CA (US); Neal Robert Fornaciari, Tracey, CA (US); Jim Jihchyun Chang, San Ramon, CA (US)

(73) Assignee: EUV LLC, Santa Clara, CA (US)

( * ) Notice: Subject to any disclaimer, the term of this patent is extended or adjusted under 35 U.S.C. 154(b) by 50 days.

(21) Appl. No.: 09/808,587

(22) Filed: Mar. 13, 2001

(65) Prior Publication Data

US 2002/0159568 A1 Oct. 31, 2002

(51) Int. Cl.[7] ..... H01J 35/00

(52) U.S. Cl. ..... 378/119; 378/143; 250/504 R; 372/5; 372/76; 372/87

(58) Field of Search ..... 378/119, 143; 250/504 R, 493.1; 372/5, 76, 87

(56) References Cited

U.S. PATENT DOCUMENTS

| | | | | |
|---|---|---|---|---|
| 4,596,018 A | | 6/1986 | Gruber et al. | |
| 4,673,417 A | | 6/1987 | Göransson et al. | |
| 4,782,210 A | | 11/1988 | Nelson et al. | |
| 5,499,282 A | | 3/1996 | Silfvast et al. | |
| 5,557,629 A | | 9/1996 | Mizoguchi et al. | |
| 5,577,092 A | | 11/1996 | Kubiak et al. | |
| 5,963,616 A | | 10/1999 | Silfvast et al. | |
| 6,031,241 A | * | 2/2000 | Silfvast et al. | 250/493.1 |
| 6,188,076 B1 | * | 2/2001 | Silfvast et al. | 250/493.1 |
| 6,356,618 B1 | * | 3/2002 | Fornaciari et al. | 372/5 |

OTHER PUBLICATIONS

Klosner, M.A. et al., "Intense plasma discharge source at 13.5 nm for extreme–ultraviolet lithography", Optic Letters, vol. 22, No. 1, 1997, pp. 34–36.

Klosner, M.A. et al., "Intense xenon capillary discharge extreme–ultraviolet source in the 10–16–nm–wavelength region", Optics Letters, vol. 23, No. 20, 1998, pp. 1609–1611.

(List continued on next page.)

*Primary Examiner*—David P. Porta
*Assistant Examiner*—Pamela R. Hobden
(74) *Attorney, Agent, or Firm*—Burns, Doane, Swecker & Mathis LLP

(57) ABSTRACT

It has been demonstrated that debris generation within an electric capillary discharge source, for generating extreme ultraviolet and soft x-ray, is dependent on the magnitude and profile of the electric field that is established along the surfaces of the electrodes. An electrode shape that results in uniform electric field strength along its surface has been developed to minimize sputtering and debris generation. The electric discharge plasma source includes: (a) a body that defines a circular capillary bore that has a proximal end and a distal end; (b) a back electrode positioned around and adjacent to the distal end of the capillary bore wherein the back electrode has a channel that is in communication with the distal end and that is defined by a non-uniform inner surface which exhibits a first region which is convex, a second region which is concave, and a third region which is convex wherein the regions are viewed outwardly from the inner surface of the channel that is adjacent the distal end of the capillary bore so that the first region is closest to the distal end; (c) a front electrode positioned around and adjacent to the proximal end of the capillary bore wherein the front electrode has an opening that is communication with the proximal end and that is defined by a non-uniform inner surface which exhibits a first region which is convex, a second region which is substantially linear, and third region which is convex wherein the regions are viewed outwardly from the inner surface of the opening that is adjacent the proximal end of the capillary bore so that the first region is closest to the proximal end; and (d) a source of electric potential that is connected across the front and back electrodes.

29 Claims, 13 Drawing Sheets

OTHER PUBLICATIONS

Silfvast, W.T., et al., "High–power plasma discharge source at 13.5 nm and 11.4 nm for EUV lithography", Proceedings of SPIE, Yuli Vladimirsky, 3676, pp. 272–275, 1999.

Dedkov, V.S. et al., "Properties of Rhombohedral Pyrolytic Boron Nitride", Inorganic Materials, vol. 32, No. 6, 1996, pp. 609–614.

Duclaux, L., et al. "Structure and low–temperature thermal conductivity of pyrolytic boron nitride", Physical Review B, vol. 46, No. 6, 1992, pp. 3362–3367.

Moore, A.W., "Compression Annealing of Pyrolytic Boron Nitride" "Letters to the Editor", vol. 221, 1969, pp. 1133–1134.

Mirkarimi, P.B. et al., "Advances in the reduction and compensation of film stress in high–reflectance multilayer coatings for extreme ultraviolet lithography", SPIE vol. 3331, pp. 133–148, Published Jun. 1998.

Kubiak, G.D., et al., "High–power extreme ultraviolet source based on gas jets", SPIE vol. 3331, pp. 81–89, Published Jun. 1998.

* cited by examiner

ELECTRODE CONFIGURATION FOR EXTREME-UV ELECTRICAL DISCHARGE SOURCE

This invention was made with Government support under Contract No. DE-AC04-94AL85000 awarded by the U.S. Department of Energy to Sandia Corporation. The Government has certain rights to the invention.

FIELD OF THE INVENTION

This invention relates generally to the production of extreme ultraviolet and soft x-rays with an electric discharge source for projection lithography.

BACKGROUND OF THE INVENTION

The present state-of-the-art for Very Large Scale Integration ("VLSI") involves chips with circuitry built to design rules of 0.25 $\mu$m. Effort directed to further miniaturization takes the initial form of more fully utilizing the resolution capability of presently-used ultraviolet ("UV") delineating radiation. "Deep UV" (wavelength range of $\lambda$=0.3 $\mu$m to 0.1 $\mu$m), with techniques such as phase masking, off-axis illumination, and step-and-repeat may permit design rules (minimum feature or space dimension) of 0.18 $\mu$m or slightly smaller.

To achieve still smaller design rules, a different form of delineating radiation is required to avoid wavelength-related resolution limits. One research path is to utilize electron or other charged-particle radiation. Use of electromagnetic radiation for this purpose will require x-ray wavelengths. Various x-ray radiation sources are under consideration. One source, the electron storage ring synchrotron, has been used for many years and is at an advanced stage of development. Synchrotrons are particularly promising sources of x-rays for lithography because they provide very stable and defined sources of x-rays, however, synchrotrons are massive and expensive to construct. They are cost effective only when serving several steppers.

Another source is the laser plasma source (LPS), which depends upon a high power, pulsed laser (e.g., a yttrium aluminum garnet ("YAG") laser), or an excimer laser, delivering 500 to 1,000 watts of power to a 50 $\mu$m to 250 $\mu$m spot, thereby heating a source material to, for example, 250,000° C., to emit x-ray radiation from the resulting plasma. LPS is compact, and may be dedicated to a single production line (so that malfunction does not close down the entire plant). The plasma is produced by a high-power, pulsed laser that is focused on a metal surface or in a gas jet. (See, Kubiak et al., U.S. Pat. No. 5,577,092 for a LPS design.)

Discharge plasma sources have been proposed for photolithography. Capillary discharge sources have the potential advantages that they can be simpler in design than both synchrotrons and LPS's, and that they are far more cost effective. Klosner et al., "Intense plasma discharge source at 13.5 nm for extreme-ultraviolet lithography," Opt. Lett. 22, 34 (1997), reported an intense lithium discharge plasma source created within a lithium hydride (LiH) capillary in which doubly ionized lithium is the radiating species. The source generated narrow-band EUV emission at 13.5 nm from the 2-1 transition in the hydrogen-like lithium ions. However, the source suffered from a short lifetime (approximately 25–50 shots) owing to breakage of the LiH capillary.

Another source is the pulsed capillary discharge source described in Silfvast, U.S. Pat. No. 5,499,282, which promised to be significantly less expensive and far more efficient than the laser plasma source. However, the discharge source also ejects debris that is eroded from the capillary bore and electrodes. An improved version of the capillary discharge source covering operating conditions for the pulsed capillary discharge lamp that purportedly mitigated against capillary bore erosion is described in Silfvast, U.S. Pat. No. 6,031,241.

Debris generation remains one of the most significant impediment to the successful development of the capillary plasma discharge sources in photolithography. Ultimately, this will reduce their efficiency to a point where they must to be replaced more often than is economically feasible. The art is in search of capillary plasma discharge sources that do not generate significant amounts of debris.

SUMMARY OF THE INVENTION

The present invention is based in part on the demonstration that debris generation within the electric capillary discharge source is dependent on the magnitude and profile of the electric field that is established along the surfaces of the electrodes. An electrode shape that results in uniform electric field strength along its surface will minimize sputtering and debris generation. Electrostatic models have been developed to predict the electric field between the electrodes. These models were applied to optimize the shape of the electrodes. An iterative approach was used in the optimization process. The predicted electric field strength profiles along the surface of the optimized electrodes show a lower peak value and improved uniformity over the initial electrode designs.

Accordingly, in one embodiment the invention is directed to an extreme ultraviolet and soft x-ray radiation electric discharge plasma source that includes:

(a) a body that defines a circular capillary bore that has a proximal end and a distal end;

(b) a back electrode positioned around and adjacent to the distal end of the capillary bore wherein the back electrode has a channel that is in communication with the distal end and that is defined by a non-uniform inner surface which exhibits a first region which is convex, a second region which is concave, and a third region which is convex wherein the regions are viewed outwardly from the inner surface of the channel that is adjacent the distal end of the capillary bore so that the first region is closest to the distal end;

(c) a front electrode positioned around and adjacent to the proximal end of the capillary bore wherein the front electrode has an opening that is communication with the proximal end and that is defined by a non-uniform inner surface which exhibits a first region which is convex, a second region which is substantially linear, and third region which is convex wherein the regions are viewed outwardly from the inner surface of the opening that is adjacent the proximal end of the capillary bore so that the first region is closest to the proximal end; and (d) a source of electric potential that is connected across the front and back electrodes.

In another embodiment, the invention is directed to a method of producing extreme ultra-violet and soft x-ray radiation that includes the steps of:

(a) providing an electric discharge plasma source that comprises:

(i) a body that defines a circular capillary bore that has a proximal end and a distal end;

(ii) a back electrode positioned around and adjacent to the distal end of the capillary bore wherein the back electrode has a channel that is in communication with the distal end and that is defined by a non-uniform inner surface which exhibits a first region which is convex, a second region which is concave, and a third region which is convex wherein the regions are viewed outwardly from the inner surface of the channel that is adjacent the distal end of the capillary bore so that the first region is closest to the distal end;

(iii) a front electrode positioned around and adjacent to the proximal end of the capillary bore wherein the front electrode has an opening that is communication with the proximal end and that is defined by a non-uniform inner surface which exhibits a first region which is convex, a second region which is substantially linear, and third region which is convex wherein the regions are viewed outwardly from the inner surface of the opening that is adjacent the proximal end of the capillary bore so that the first region is closest to the proximal end; and (iv) a source of electric potential that is connected across the front and back electrodes; and (v) a housing that defines a vacuum chamber that is in communication with the opening of the front electrode;

(b) introducing gas from a source of gas into the channel of the back electrode and into the capillary bore; and (c) causing an electric discharge in the capillary bore sufficient to create a plasma within the capillary bore thereby producing radiation of a selected wavelength less than about $1\times10^{-3}$ Torr.

An important feature of the invention is with the design of the front and back electrodes, the source of electric potential establishes substantially uniform first electric fields along the inner surface of the front electrode and substantially uniform second electric fields along the inner surface of the back electrode.

DETAILED DESCRIPTION OF THE INVENTION

Figure 1:
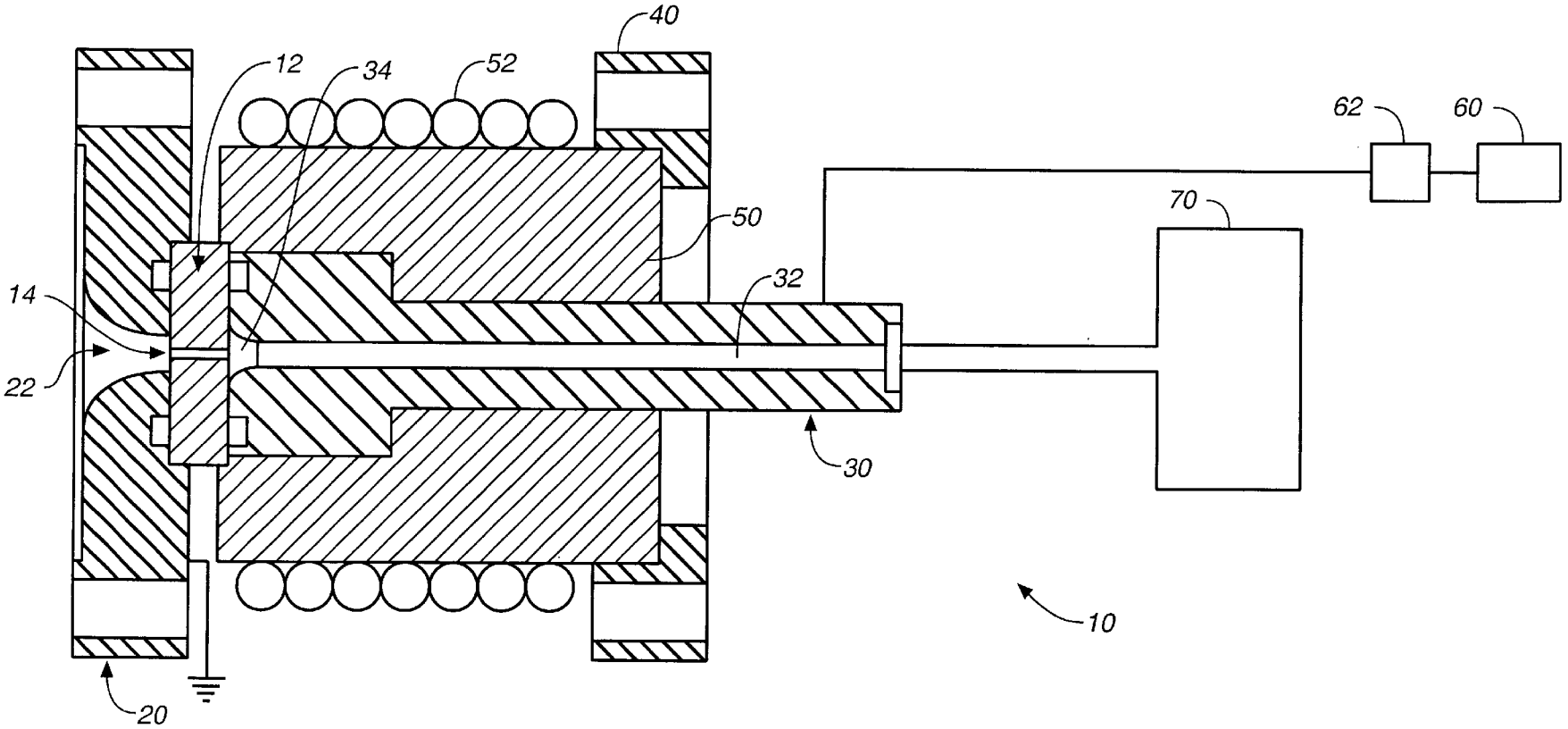
FIG. 1 is a cross sectional view of an electric capillary discharge source.

FIG. 1 is a cross-sectional view of an electric capillary discharge source 10 which preferably comprises an insulating disk 12 that has a capillary bore 14 which is centered on-axis. The disk 12 is mounted between two electrodes 20 and 30 which are in proximity to the front and back surfaces of the disk, respectively. The disk is made of a ceramic material, preferably, boron nitride, and more preferably of pyrolytic boron nitride, compression annealed pyrolytic boron nitride, or cubic boron nitride. These materials are commercially available from Advanced Ceramics of Cleveland, Ohio. It has been demonstrated that boron nitride, which is relatively highly thermally conductive (for a ceramic), is particularly suited for use in the electric discharge source because of its exceptional resistance to erosion.

Front electrode 20 is typically grounded and has an aperture 22 having a center that is aligned with the center of the capillary bore 14. Rear electrode 30 has a channel 32 with an inlet and an outlet. The outlet is connected to the capillary bore at the back end of disk 12 while the inlet is connected to a gas source 70. Rear electrode 30 is also connected to a source of electric potential 60 which includes a switch mechanism 62 to generate electric pulses. To facilitate the removal of heat, front and rear electrodes and capillaries are preferably encased in a thermally conductive housing 50 which in turn can be surrounded by coils 52 through which a coolant, e.g., water, is circulated. Front and rear electrodes are made of any suitable electrically conductive and erosion resistant material such as refractory metals, e.g., stainless steel. A particularly preferred material is tantalum.

The electric capillary discharge source 10 employs a pulsed electric discharge in a low-pressure gas to excite a plasma confined within a capillary bore region. A high-voltage, high-current pulse is employed to initiate the discharge thereby creating a plasma, e.g., 2–50 eV, that radiates radiation in the EUV region. The source of gas 70 contains any suitable gas that can be ionized to generate a plasma from which radiation of the desired wavelength occurs. For generating extreme ultraviolet radiation and soft x-rays, xenon is preferred.

In operation, the opening of the front electrode is connected to a housing that defines a vacuum chamber. Causing an electric discharge in the capillary bore sufficient to create a plasma within the capillary bore produces extreme ultraviolet and soft x-ray radiation into the vacuum chamber is which is typically maintained at a pressure of less than about $1\times10^{-3}$ Torr. Typically, the electric discharge creates a 20 to 50 eV plasma. The electric discharge can be generated as pulse electric discharges exhibiting a discharge rate, for example, between about 0.5 to 4 $\mu$sec.

As further described herein, finite element models were applied to predict the electric field distribution between the electrodes in the electric capillary discharge source. The model predictions were used to optimize the shape of the front and rear electrodes for reduced debris generation. Design changes in the front electrode were subtle. Changes to the rear electrode were more dramatic, with changes in the surface from convex to concave resulting in a significant improvement in the electric field uniformity. Optimization of both the front and rear electrodes utilized design guidelines that resulted from the numerical analysis. The first guideline is to contour the region of the electrode nearest the capillary to minimize the variation in distance from the capillary. This is the reason for changing the electrode surfaces from convex to concave. The second guideline is to avoid slope discontinuities and tight corners on the. electrode surface. The sensitivity of the model results to discontinuities in the surface slope indicates that the electrode performance will be dependent on the surface finish. Debris generation from a new electrode may result in a certain amount of self-smoothing. This self-smoothing effect could result in a significant reduction in debris generation following an initial break-in period.

Design of Front and Rear Electrodes

The electric field strength along the electrode surfaces was predicted using finite element analysis. A finite element analysis code, Coyote 3, developed at Sandia National Laboratories, was used to perform these calculations. Coyote 3 was original developed as a heat transfer analysis code. Since Laplace's equation represents both steady-state heat conduction (Equation 1) and electric potential (Equation 2), this code was used to predict the electric potential between the electrodes by simply mapping temperature (T) to voltage (V). The electric field strength, E, along the electrode surfaces was determined from the electric potential gradient (Equation 3).

$$\nabla^2 T=0, \text{ (Steady-state heat conduction)} \quad (1)$$

$$\nabla^2 V=0, \text{ (Steady-state electric potential)} \quad (2)$$

$$E=\left(\left[\left(\frac{\partial V}{\partial x}\right)^2+\left(\frac{\partial V}{\partial y}\right)^2+\left(\frac{\partial V}{\partial z}\right)^2\right]\right)^{\frac{1}{2}}, \text{ (E-field strength)} \quad (3)$$

Figure 2A:
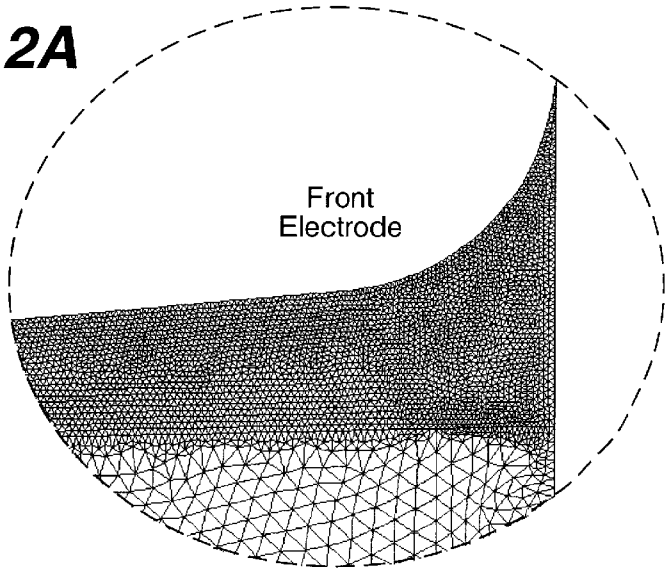
FIGS. 2A and 2B illustrate the finite element mesh used for electrostatic calculations.
Figure 2B:
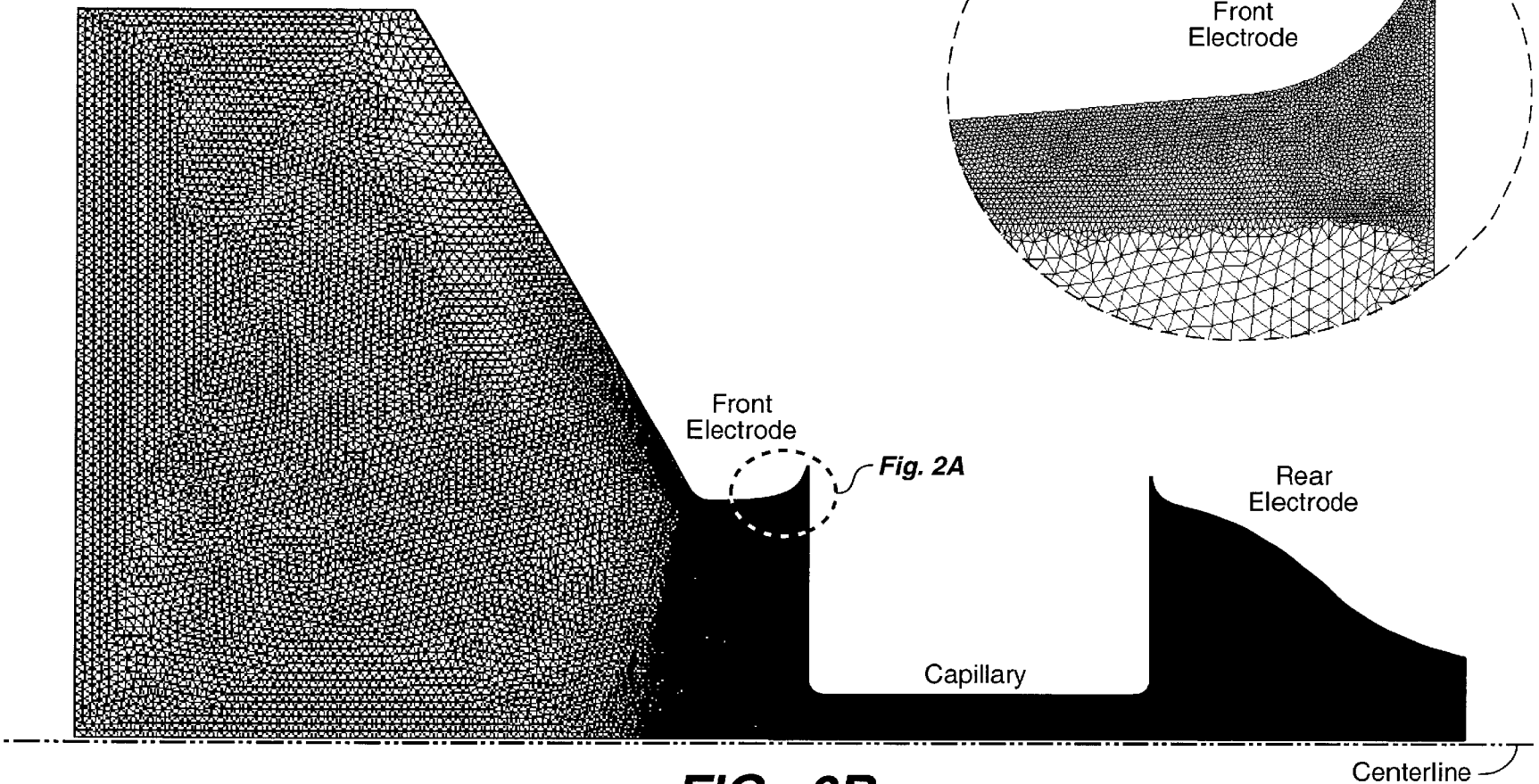

The region enclosed by the electrodes and capillary is rotationally symmetric The electrostatic calculations were done using a two-dimensional axisymmetric model. In order to capture localized electric field spikes near slope discontinuities, calculations were run with an extremely fine finite element mesh. A typical mesh had approximately 60,000 elements as shown in FIGS. 2A and 2B. All simulations were run with a voltage difference of 400 V applied between the front and rear electrodes. The electric potential boundary conditions were applied uniformly along each electrode. The 400 V value is arbitrary. All plots labeled "Electric Field Strength" are scaled by $10^{-5}$ and have units of V/mm.

Figure 3:
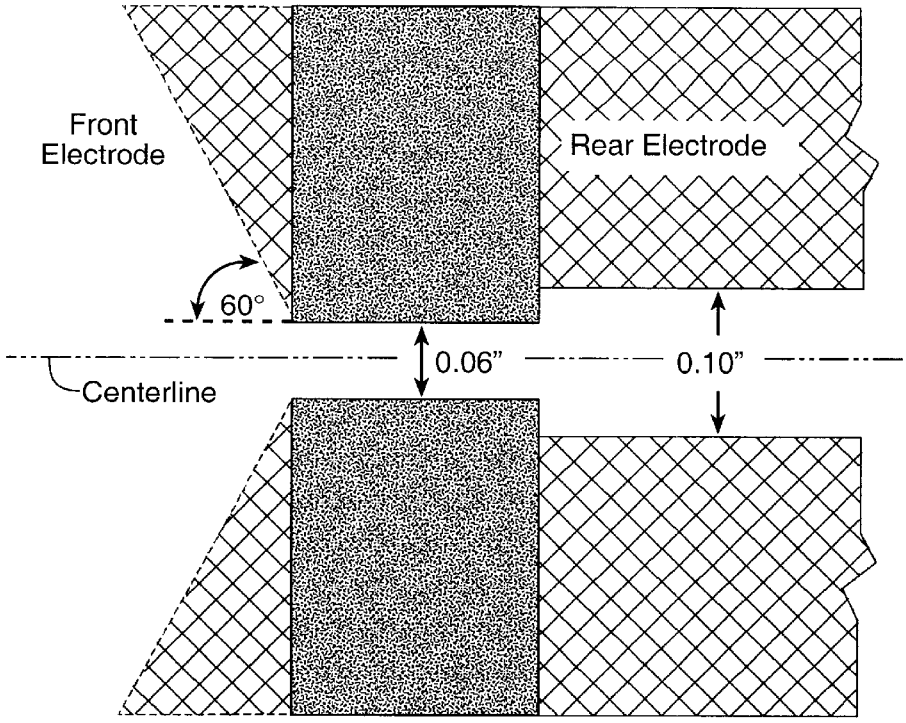
FIG. 3 illustrates the geometry constraints on the electrode shape optimization.

Iterative calculations were performed to optimize the shape of the electrodes. The design objective was to minimize the variation in the electric field strength profile along both the front and rear electrodes. Some geometry constraints were placed on the electrodes. The cross-sectional area that each electrode was required to fit within is shown as the cross-hatched areas in FIG. 3. The geometry of the capillary remained unchanged for the following analyses.

Results

Figure 4:
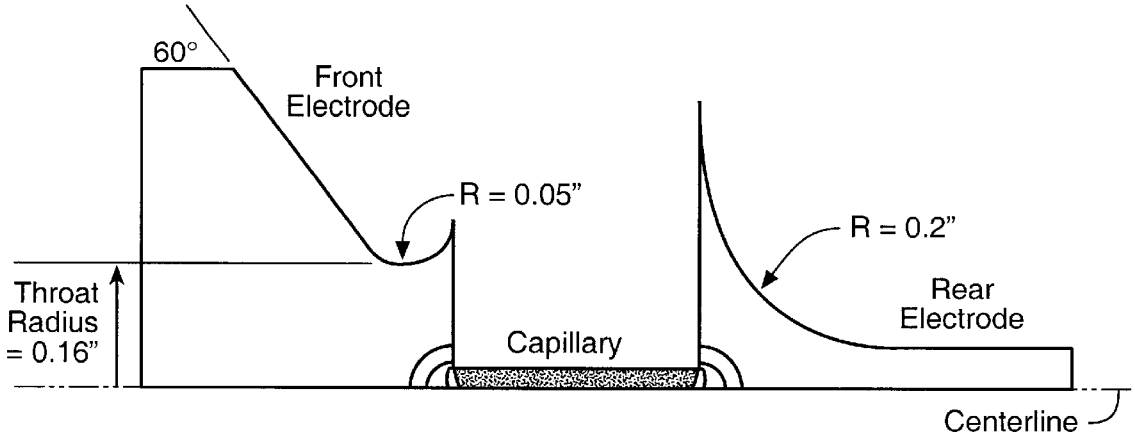
FIG. 4 illustrates the starting geometry for the electrode optimization.
Figure 5A:
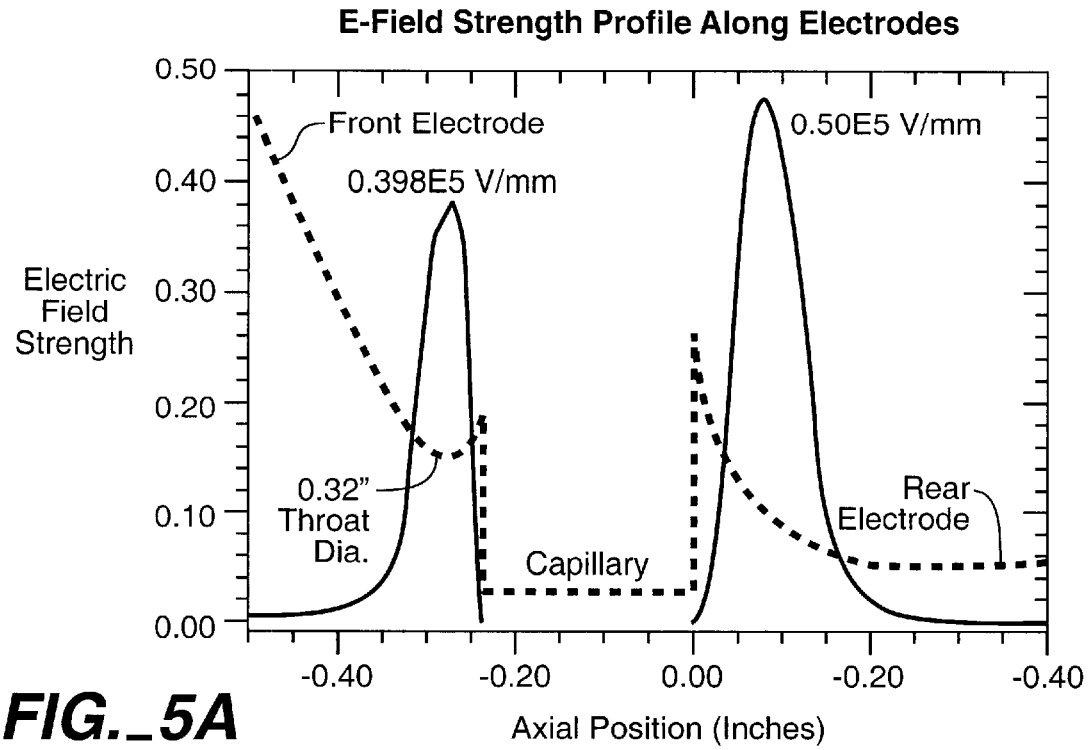
FIGS. 5A and 5B are electric field strength profiles along the electrodes and capillary.
Figure 5B:
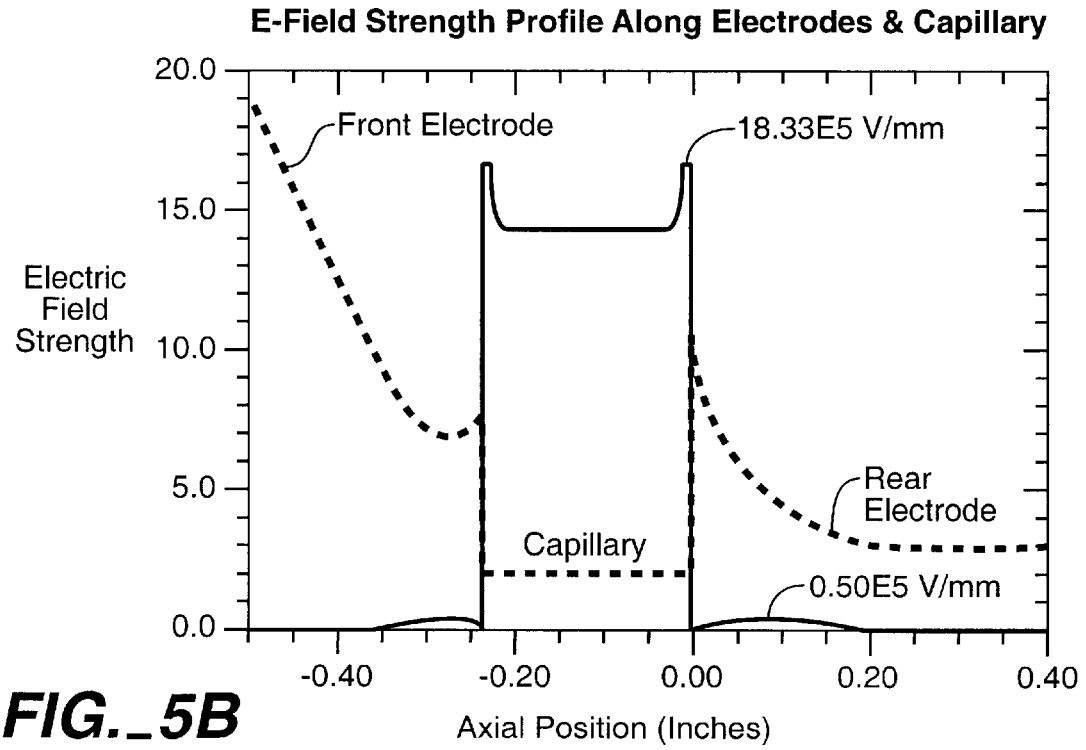
Figure 6A:
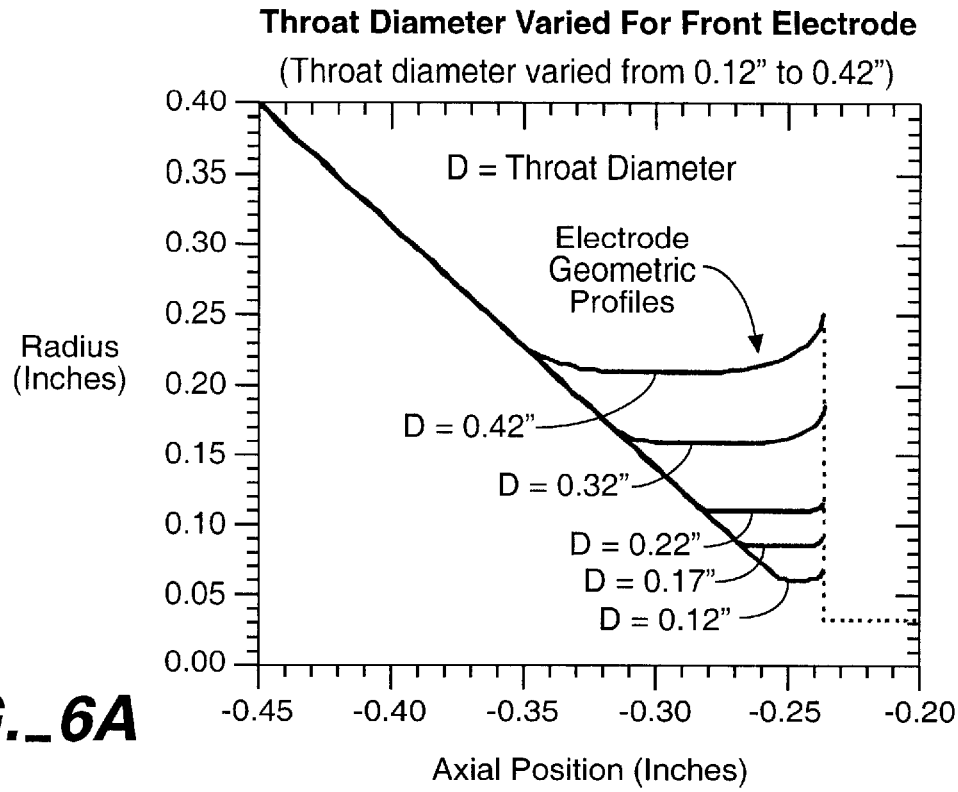
FIGS. 6A and 6B are five variations of the front electrode geometry and the corresponding electric field strength profiles.
Figure 6B:
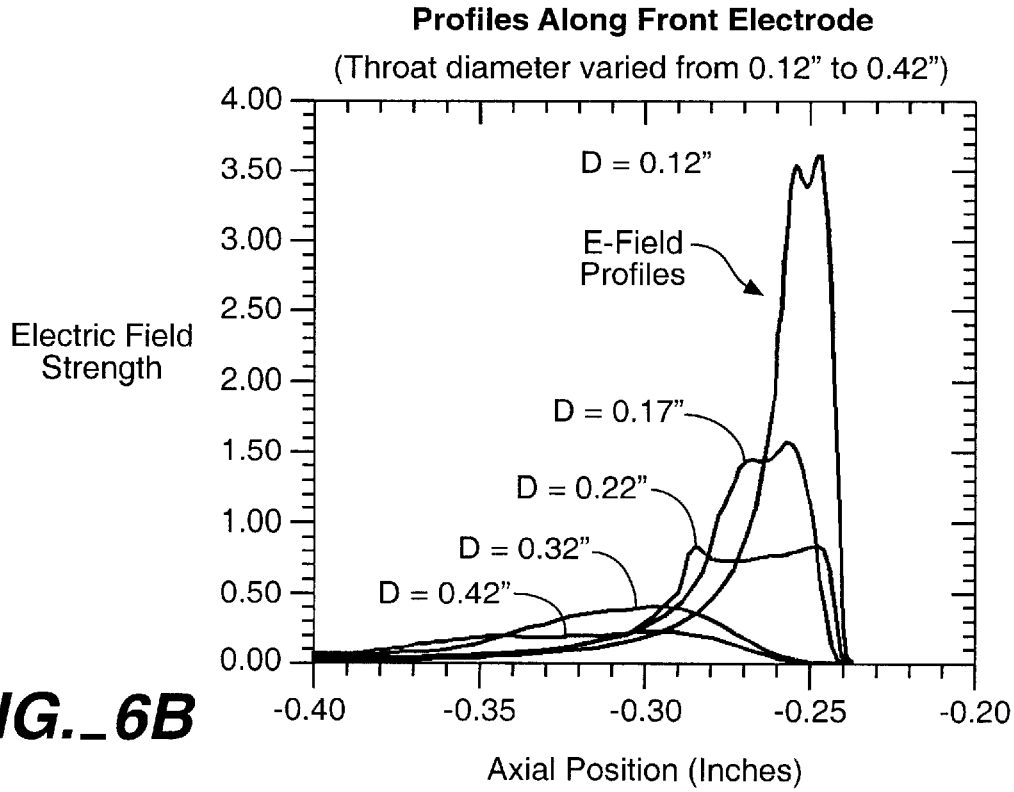

The initial geometry for the electrode design optimization is shown in FIG. 4. The minimum throat diameter of the front electrode was 0.32 in. (8.1 mm). Both the front and rear electrodes were characterized by convex surfaces that face the capillary. The radius of the convex region of the front electrode was 0.05 in. (1.3 mm) and the radius of the convex region of the rear electrode was 0.2 in. (5.1 mm). Finite element model results of the electric field strength distribution are shown in FIGS. 5 and 6A and 6B. Electric field contours are plotted in FIG. 5. The electric field strength profiles along the surfaces of the electrodes are shown in FIGS. 5A and 5B. The plot of FIG. 5A shows the E-field on front and rear electrodes. The plot of FIG. 5B shows the E-field on electrodes and capillary. A different y-axis scale is used for each plot. Note that the peak electric field values occur at points on the electrodes that are closest to the capillary. The electric field strength along the capillary surface is significantly greater than that along the electrodes.

Front Electrode Optimization

Figure 7:
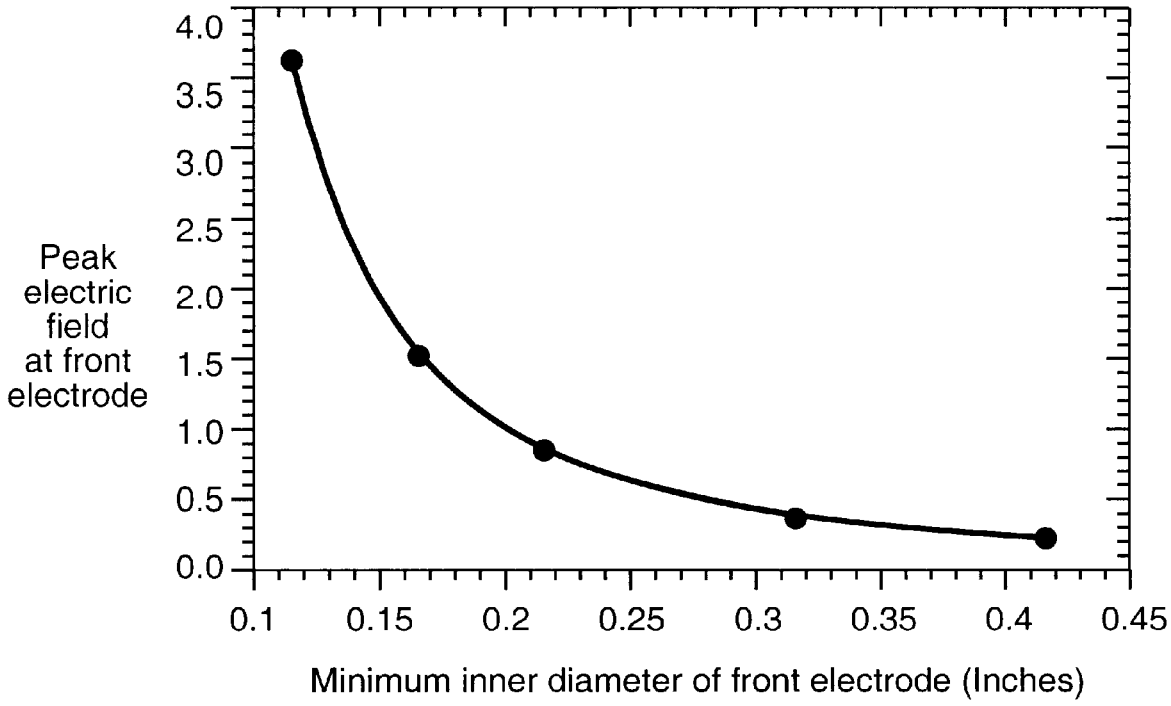
FIG. 7 graphically depicts how the peak electric field strength on the front electrode decreases as the throat diameter increases.

The throat diameter is a key parameter in the front electrode design. Throat diameters ranging from 0.12 in. (3.0 mm) to 0.42 in. (10.7 mm) were modeled. The geometry of 5 different front electrodes and their corresponding electric field profiles are shown in FIGS. 6A and 6B, respectively. The peak electric field value on the front electrode is plotted as a function of the electrode throat diameter in FIG. 7. These results show that the electric field strength has a strong nonlinear dependence on throat diameter. The electric field cannot be minimized by arbitrarily increasing the electrode throat diameter. As the throat diameter increases, the required voltage increases for a given lamp power. The model results indicate that the 0.32 in. (8.1 mm) throat diameter of the initial design is a good compromise. At this diameter, the voltage requirements are acceptable and, as shown in FIG. 7, further increases in diameter lead to a diminishing rate of decrease in the electric field strength.

Figure 8A:
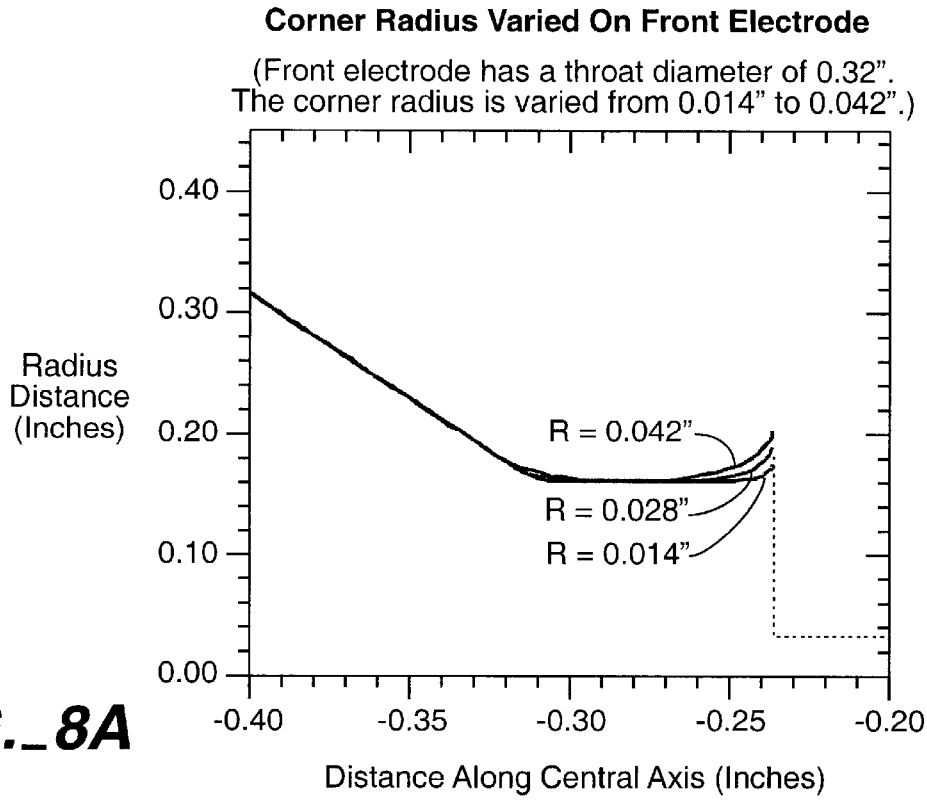
FIGS. 8A and 8B illustrate three variations of the front electrode with a throat diameter of 0.32 in. (8.1 mm) and the corresponding electric field strength profiles.
Figure 8B:
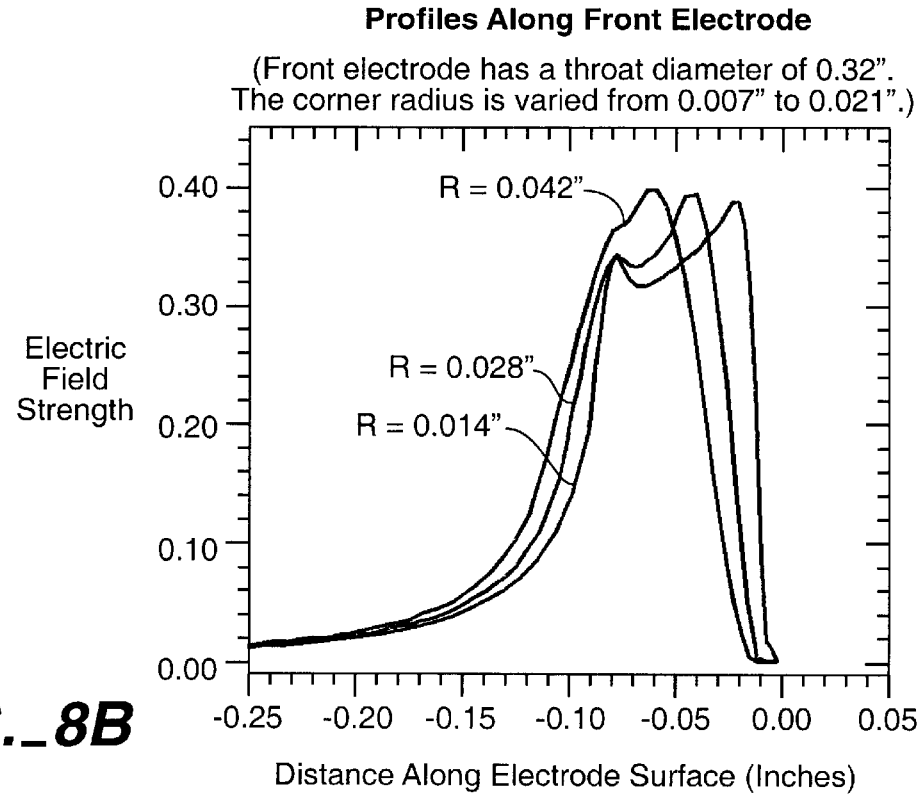
Figure 9A:
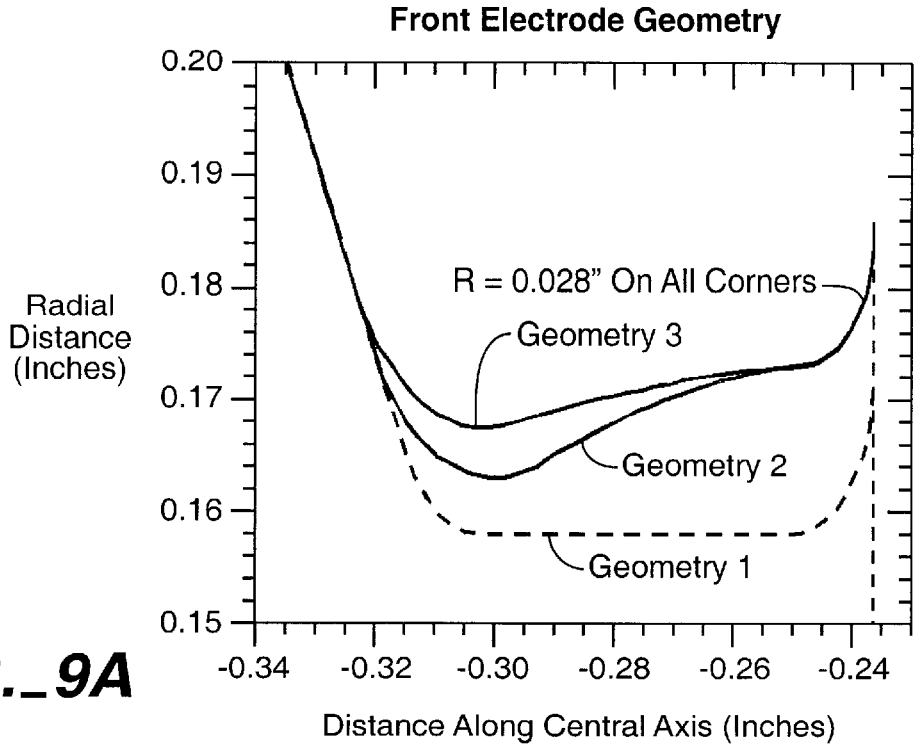
FIGS. 9A and 9B illustrate that the front electrode geometry is contoured to minimize variations in the electric field strength.
Figure 9B:
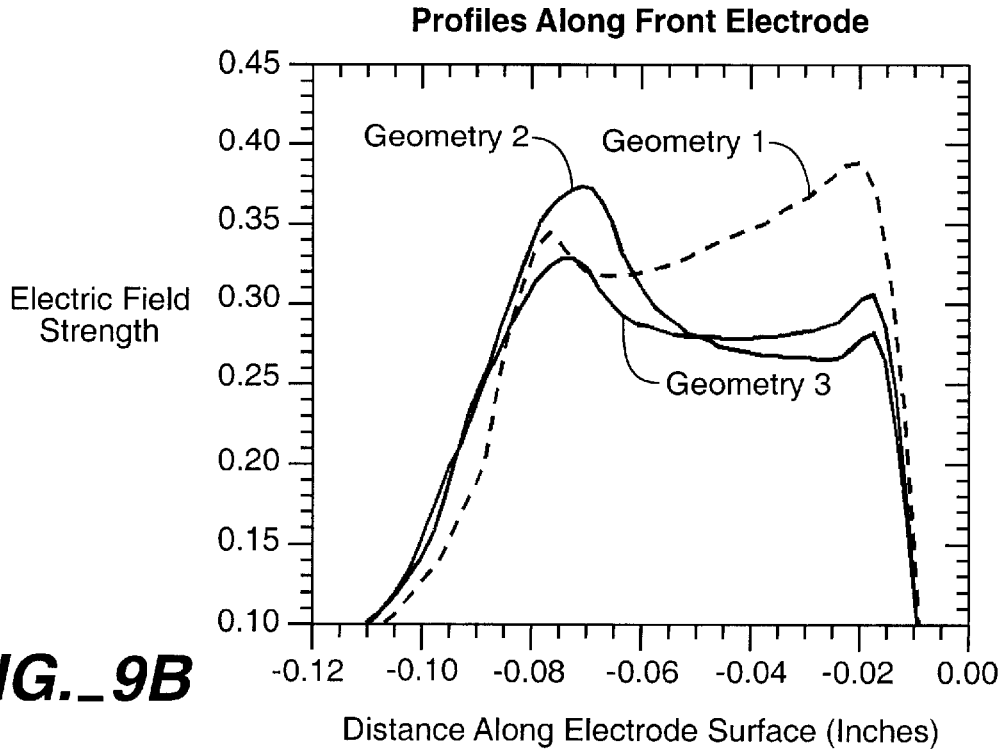

The model predicted electric field strength profiles along the electrode surface have two distinct characteristics: (1) peak values occur in regions closest to the capillary opening and (2) local spikes coincide with tight curves. Several front electrode designs with a throat diameter of 0.32 in. (8.1 mm) were evaluated with a flat surface along the throat bounded by small radius transitional curves. Model results for radii of 0.014 in. (0.36 mm), 0.028 in. (0.71 mm), and 0.042 in. (1.1 mm) are shown in FIGS. 8A and 8B. These results show that the electric field uniformity along the throat tends to improve as the corner radii decrease. The electrode with the 0.042 in. (1. 1 mm) radii has a single peak in the electric field profile while the electrodes with the smaller radii have two distinct peaks at each corner. For the cases with two distinct peaks, the electric field strength decreases from the right peak to the left peak. This decrease corresponds to an increase in distance from the capillary. To compensate for this variation in electric field strength, the throat of the electrode was contoured to minimize the variation in distance from the capillary. FIGS. 9A and 9B shows three front electrode shapes along with their corresponding electric field profiles. The corner radius for each of these electrodes is 0.028 in. (0.71 mm). Geometry 3 has a radius of curvature equal to about 2× the electrode-to-capillary distance. These results show that the electric field profile can be modified by slightly tilting the surface of the electrode throat with respect to the capillary.

Figure 10A:
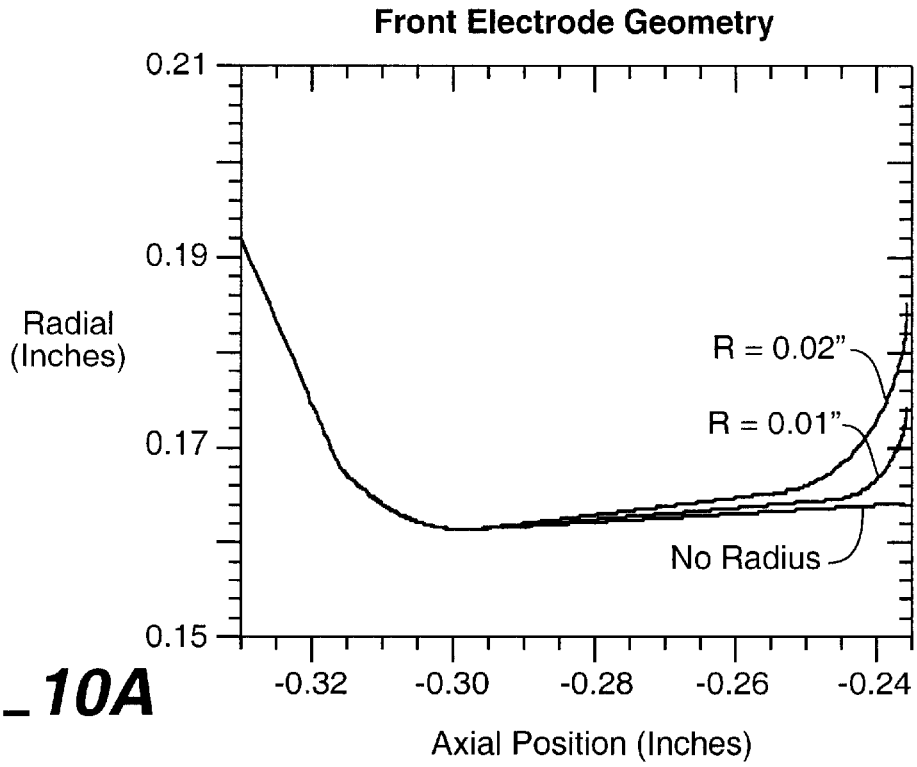
FIGS. 10A and 10B are comparisons of the final three front electrode design iterations.
Figure 10B:
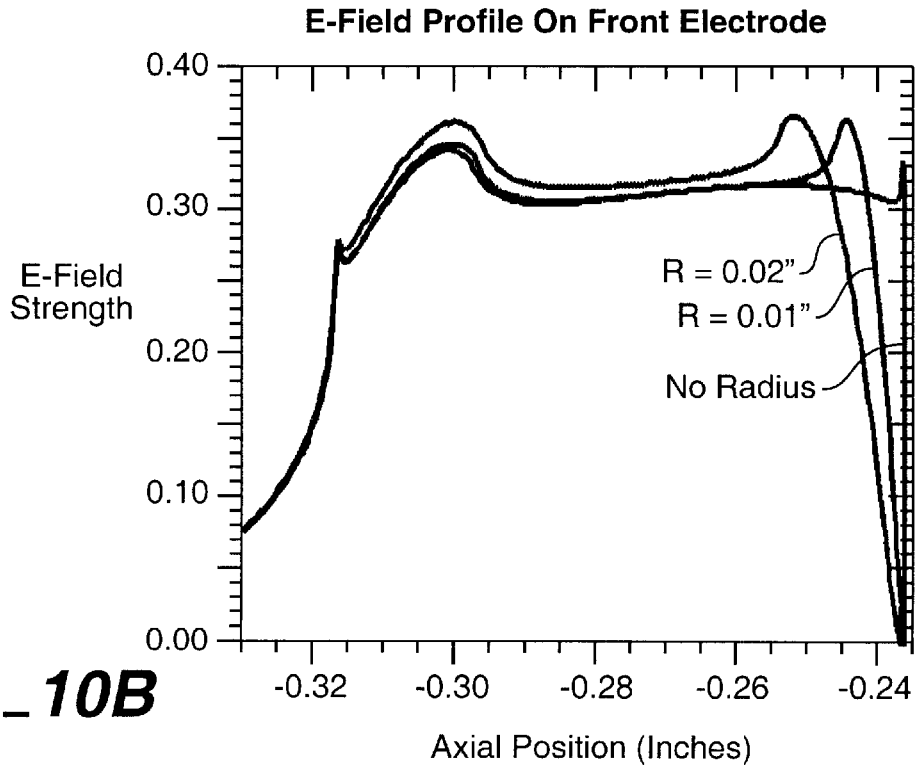

As a final step, the front electrode design was fine-tuned for ease of fabrication and electric field uniformity. It was determined that the cross-sectional profile of the electrode can be simplified to two flat sections and two single-radius curves with no significant increase in electric field variation. An important design requirement is that the transition from the flat region to the curved region must occur with out a discontinuity in the slope. Three final electrode designs along with their corresponding electric field profiles are shown in FIGS. 10A and 10B, which compare the final three front electrode design iterations. Each of these cases shows good uniformity in the electric field across the throat of the nozzle. The electrode design labeled "No radius" has a sharp corner at the inner edge which produces a singularity in the electric field. The model cannot fully resolve this singularity so the spike in the electric field is under-predicted. The electrode design with the 0.02 in. (0.51 mm) radius was chosen as the final design. Specifications of the electrode cross-sectional profile are given in FIG. 11.

Figure 11:
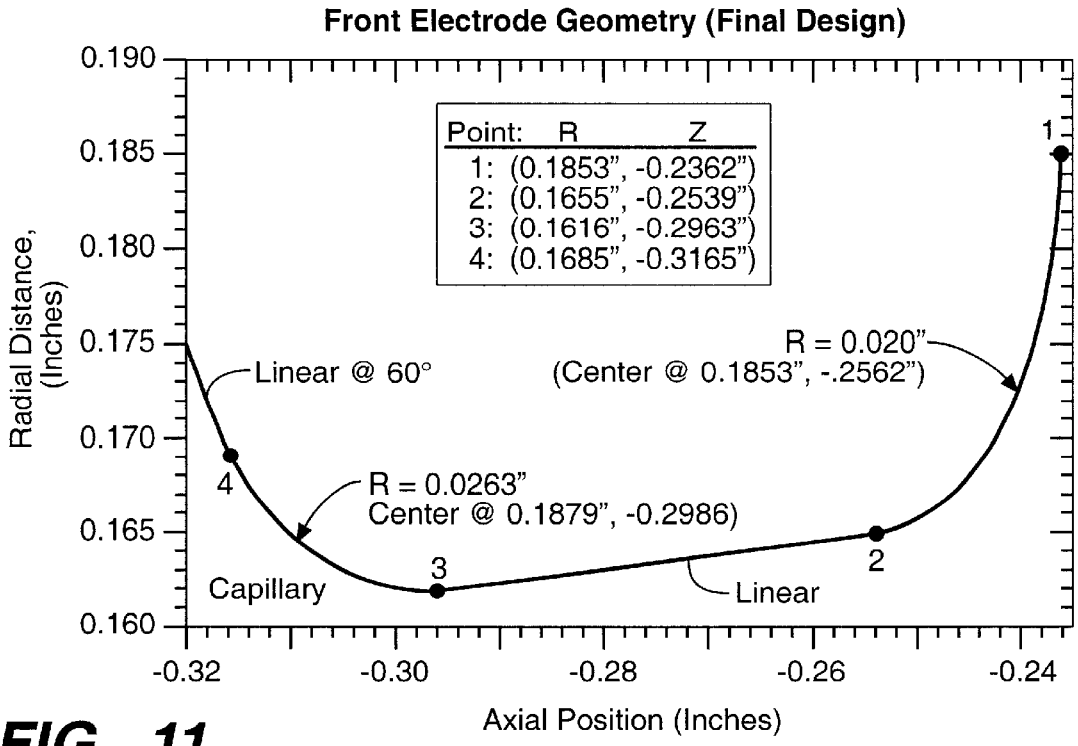
FIG. 11 shows the specifications for the shape of the front electrode.

Referring to FIG. 11, typically the side of the front electrode where point 1 is located will be positioned adjacent to the proximal end of the capillary bore. One method of characterizing the dimensions of this preferred front electrode design is with respect to the length of the capillary bore. For a capillary bore with length L, as measured from the proximal end to the distal end along a central x axis, the position of the capillary bore at the distal end can be designated position zero of the x axis and the proximal end is designated −L. Thus the positions of the first, second, and third regions of the inner surface of the front electrode are defined by points 1, 2, 3 and 4 along the x axis wherein point 1 is substantially coincidental to −L. Based on these designations, point 2 is typically equal to 1.05 to 1.10, and preferably 1.075, of the value −L, point 3 is typically equal to 1.23 to 1.27, and preferably about 1.25, of the value −L, and point 4 is typically equal to 1 .32 to 1.36, and preferably equal to about 1.34, of the value −L with the first region being situated between points 1 and 2, the second region being situated between points 2 and 3, and the third region being situated between points 3 and 4. In addition, referring to FIG. 11, the inner surface of the front electrode can have a fourth region that is substantially linear and defines an angle of 55 to 65 degrees, and preferably about 60 degrees, relative to the x axis and that extends beyond point 4 to a point at least equal to about 1.5 of the value −L.

Another method of characterizing the dimensions of this preferred front electrode design is with respect to the radius of the capillary bore. For a capillary bore with radius R as measured from the center of the capillary bore along a y axis, the position of the capillary bore at the center can be designated position zero of the y axis and the positions of points 1, 2, 3, and 4 of the front electrode as measured along the y axis are such that the distance from point 1 to the x axis is equal to 6.00 to 6.30, and preferably about 6.18, times the value R, the distance from point 2 to the x axis is equal to 5.45 to 5.60, and preferably about 5.52 times, the value R, the distance from point 3 to the x axis is equal to 5.33 to 5.45, and preferably about 5.39 times the value R, and the distance from point 4 to the x axis is equal to 5.52 to 5.72, and preferably about 5.62 times the value R.

Rear Electrode Optimization

Figure 12A:
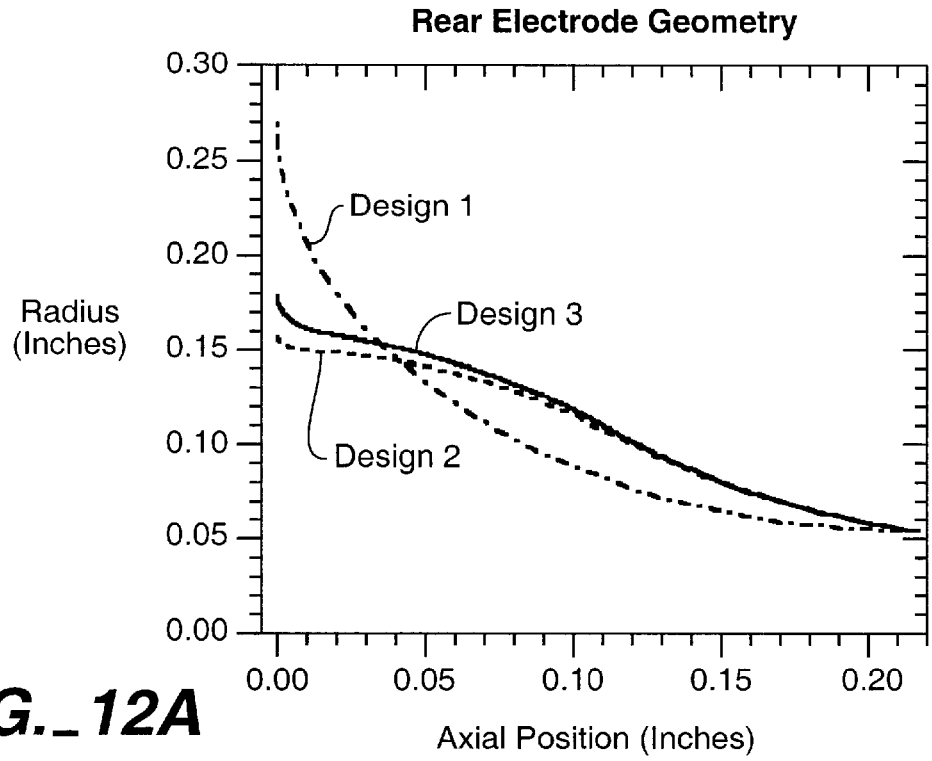
FIGS. 12A and 12B are comparisons of three rear electrode design iterations.
Figure 12B:
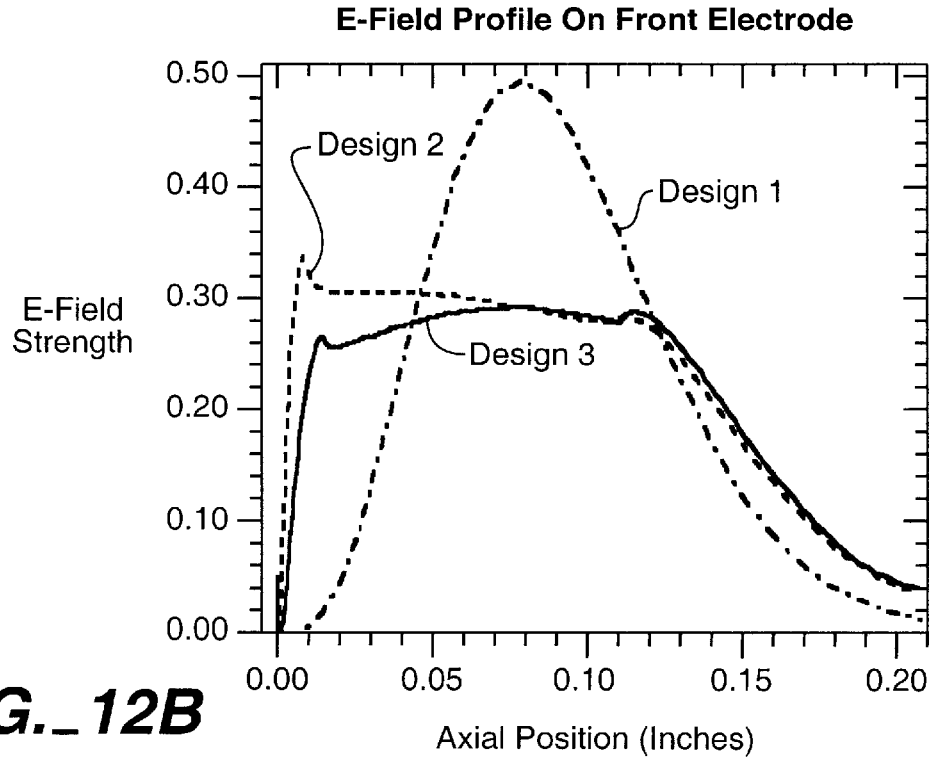

Design of the rear electrode followed the same approach as the front electrode. The surface near the inner edge was contoured to minimize the variation in distance to the capillary. This resulted in a slightly concave shape as opposed to the convex shape of the initial design. A 0.02 in. (5.1 mm) radius was put on the inner edge as was done with the front electrode. Three designs for the rear electrode along with their corresponding electric field profiles are shown in FIGS. 12A and 12B. Electrode designs 2 and 3 have significantly flatter electric field profiles than design 1 (the initial design). Design 3 was chosen as the particularly preferred final design. Specifications of the electrode cross-sectional profile are given in FIG. 13.

Figure 13:
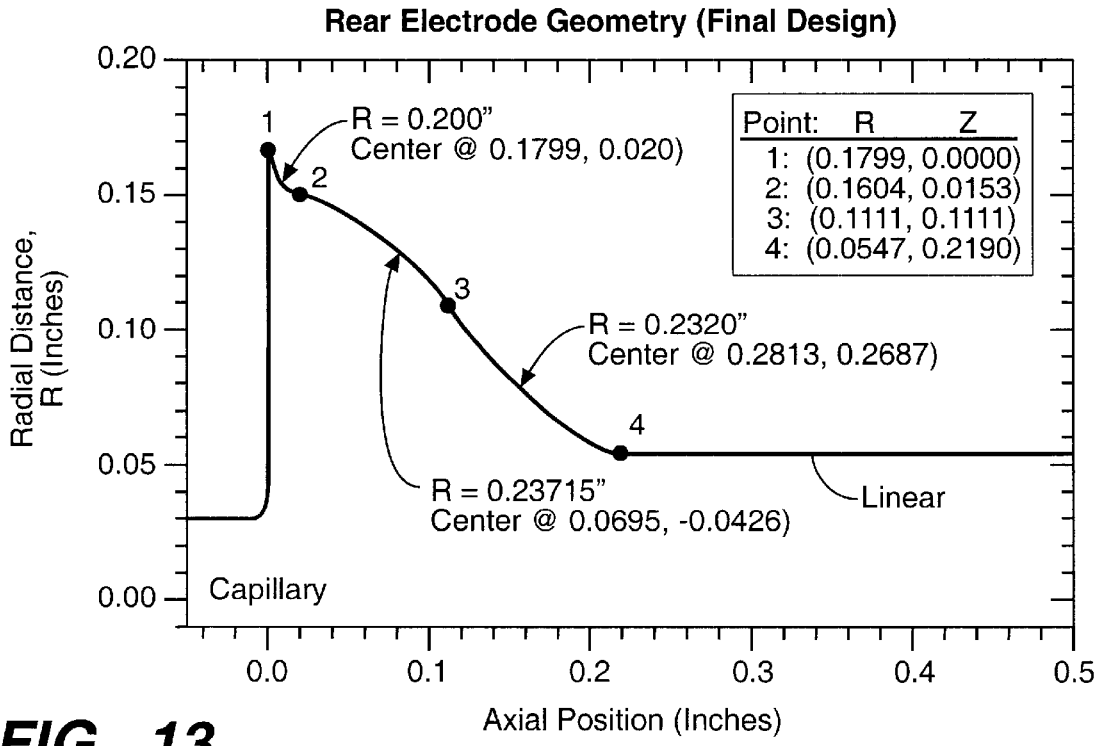
FIG. 13 illustrates the specifications for the shape of the rear electrode.

Referring to FIG. 13, typically the side of the rear electrode where point 1 is located will be positioned adjacent to the distal end of the capillary bore. One method of characterizing the dimensions of this preferred rear electrode is with respect to the length of the capillary bore. For a capillary bore with a length L as measured from the proximal end to the distal end along a central x axis, the position of the capillary bore at the distal end can be designated position zero of the x axis and thus the positions of the first, second, and third regions of the inner surface of the back electrode are defined by points 1, 2, 3 and 4 along the x axis. In a preferred design, point 1 is substantially coincidental to zero, point 2 is equal to 0.04 to 0.08, and preferably about 0.06, of the value of L, point 3 is equal to 0.42 to 0.52, and preferably about 0.47 of the value of L, and point 4 is equal to 0.83 to 1.03, and preferably about 0.93, of the value of L with the first region being situated between points 1 and 2, the second region being situated between points 2 and 3, and the third region being situated between points 3 and 4. In addition, the inner surface of the back electrode can further exhibits a fourth region that is substantially linear and parallel to the x axis and that extends beyond point 4 for a length equal to at least about 0.2 of the value L.

Another method of characterizing the dimensions of this preferred rear electrode design is with respect to the radius of the capillary bore. For a capillary bore with radius R as measured from the center of the capillary bore along a y axis, the position of the capillary bore at the center can be designated position zero of the y axis and the positions of points 1, 2, 3, and 4 of the inner surface of the back electrode as measured along the y axis are such that the distance from point 1 to the x axis is equal to 5.8 to 6.2, and preferably about 6.0, times the value R, the distance from point 2 to the x axis is equal to 5.25 to 5.45, and preferably about 5.35 times the value R, the distance from point 3 to the x axis is equal to 3.4 to 4.0, and preferably about 3.70 times the value R, and the distance from point 4 to the x axis is equal to 1.32 to 2.32, and preferably about 1.82 times the value R.

Figure 14A:
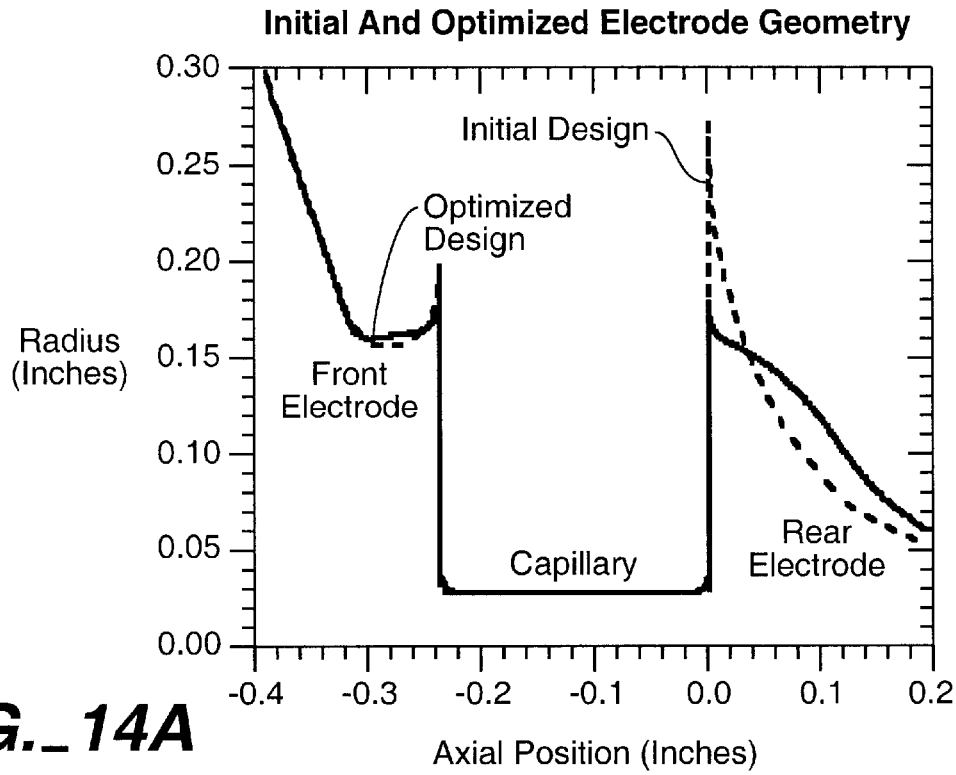
FIG. 14 is a comparison of the initial and final designs for the front and rear electrodes.
Figure 14B:
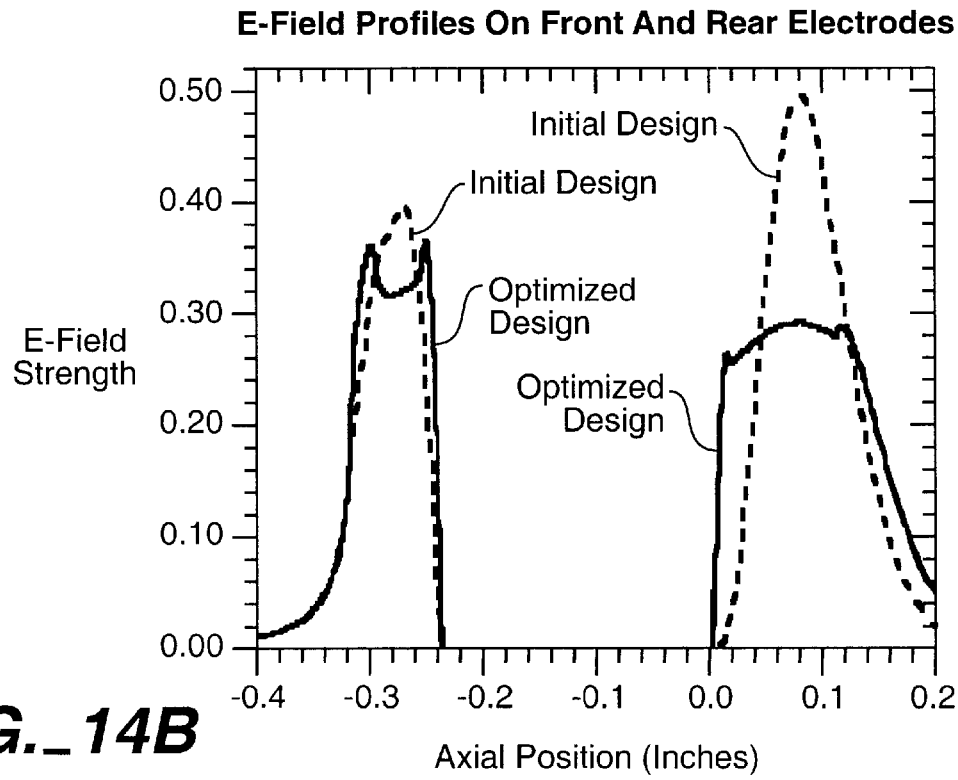
Figures 15A, 15B:
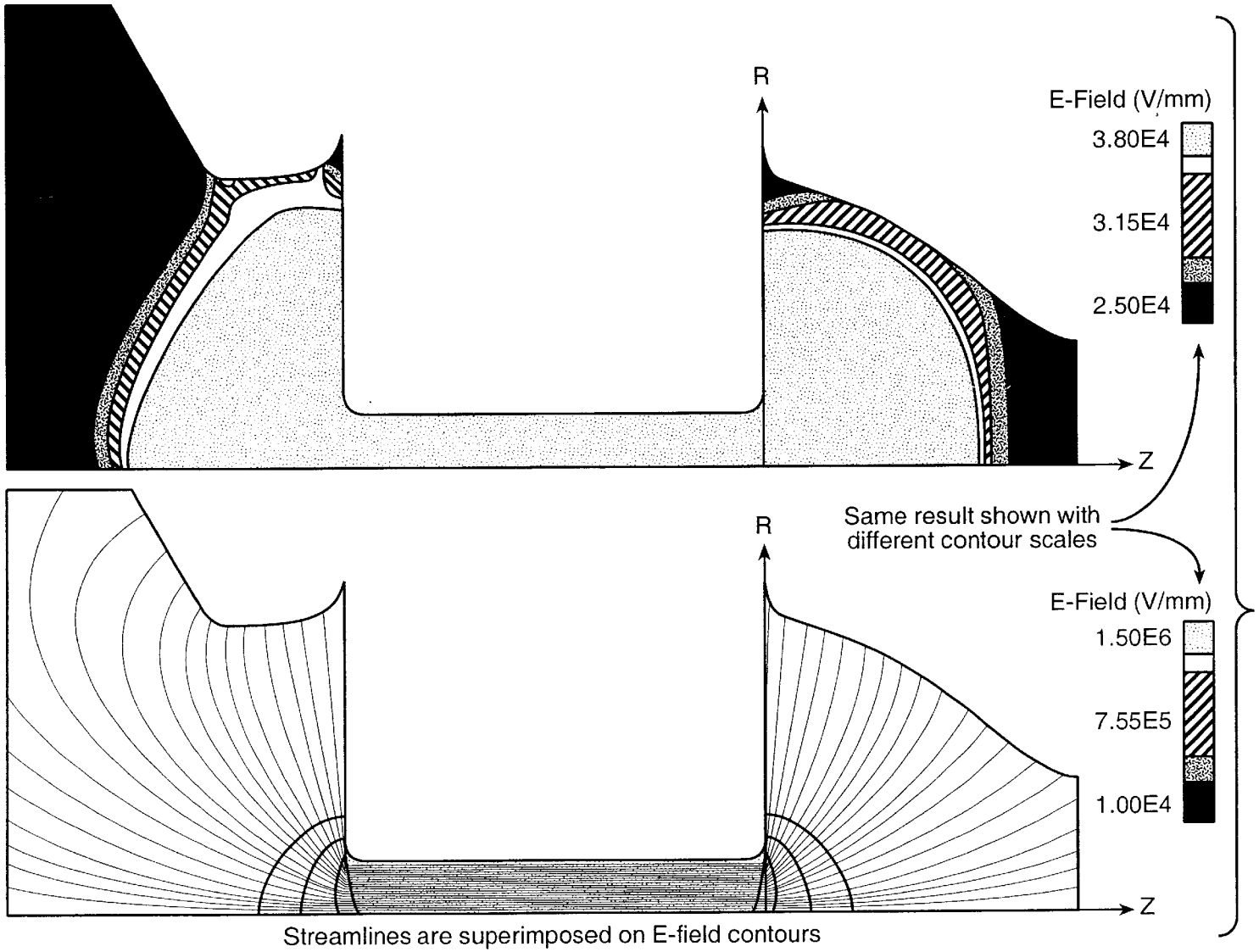
FIGS. 15A and 15B are electric field contours for the optimized front and rear electrodes.

Comparisons of the initial and final electrode front and rear designs are shown in FIGS. 14A and 14B. Predicted performance for both the electrodes was improved in terms of peak electric field strength and electric field uniformity. The electric field contours for the optimized front and rear electrodes are shown in FIGS. 15A and 15B at two different scales. The contour plot shows how the electric field strength rapidly decreases with distance from the capillary.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. An extreme ultraviolet and soft x-ray radiation electric discharge plasma source that comprises:

(a) a body that defines a circular capillary bore that has a proximal end and a distal end;

(b) a back electrode positioned around and adjacent to the distal end of the capillary bore wherein the back electrode has a channel that is in communication with the distal end and that is defined by a non-uniform inner surface which exhibits a first region which is convex, a second region which is concave, and a third region which is convex wherein the regions are viewed outwardly from the inner surface of the channel that is adjacent the distal end of the capillary bore so that the first region is closest to the distal end;

(c) a front electrode positioned around and adjacent to the proximal end of the capillary bore wherein the front electrode has an opening that is communication with the proximal end and that is defined by a non-uniform inner surface which exhibits a first region which is convex, a second region which is substantially linear, and third region which is convex wherein the regions are viewed outwardly from the inner surface of the opening that is adjacent the proximal end of the capillary bore so that the first region is closest to the proximal end; and (d) a source of electric potential that is connected across the front and back electrodes.

2. The discharge plasma source of claim 1 wherein the capillary bore has a length L as measured from the proximal end to the distal end along a central x axis and wherein the position of the capillary bore at the distal end is designated position zero of the x axis and the positions of the first, second, and third regions of the inner surface of the back electrode are defined by points 1, 2, 3 and 4 along the x axis wherein point 1 is substantially coincidental to zero, point 2 is equal to about 0.06 of the value of L, and point 3 is equal to about 0.47 of the value of L, and point 4 is equal to about 0.93 of the value of L with the first region being situated between points 1 and 2, the second region being situated between points 2 and 3, and the third region being situated between points 3 and 4.

3. The discharge plasma source of claim 2 wherein the inner surface of the back electrode further exhibits a fourth region that is substantially linear and parallel to the x axis and that extends beyond point 4 for a length equal to at least about 0.2 of the value L.

4. The discharge plasma source of claim 2 wherein the capillary bore has a radius R as measured from the center of the capillary bore along a y axis and wherein the position of the capillary bore at the center is designated position zero of the y axis and the positions of points 1, 2, 3, and 4 of the inner surface of the back electrode as measured along the y axis are such that the distance from point 1 to the x axis is equal to about 6.0 times the value R, the distance from point 2 to the x axis is equal to about 5.35 times the value R, the distance from point 3 to the x axis is equal to about 3.70 times the value R, and the distance from point 4 to the x axis is equal to about 1.82 times the value R.

5. The discharge plasma source of claim 1 wherein the capillary bore has a length L as measured from the proximal end to the distal end along a central x axis and wherein the position of the capillary bore at the distal end is designated position zero of the x axis and the proximal end is designated −L and the positions of the first, second, and third regions of the inner surface of the front electrode are defined by points 1, 2, 3 and 4 along the x axis wherein point 1 is substantially coincidental to −L, point 2 is equal to about 1.075 of the value −L, and point 3 is equal to about 1.25 of the value −L, and point 4 is equal to about 1.34 of the value −L with the first region being situated between points 1 and 2, the second region being situated between points 2 and 3, and the third region being situated between points 3 and 4.

6. The discharge plasma source of claim 5 wherein the inner surface of the front electrode further exhibits a fourth region that is substantially linear and defines an angle of about 60 degrees relative to the x axis and that extends beyond point 4 to a point at least equal to about 1.5 of the value −L.

7. The discharge plasma source of claim 5 wherein the capillary bore has a radius R as measured from the center of the capillary bore along a y axis and wherein the position of the capillary bore at the center is designated position zero of the y axis and the positions of points 1, 2, 3, and 4 of the front electrode as measured along the y axis are such that the distance from point 1 to the x axis is equal to about 6.18 times the value R, the distance from point 2 to the x axis is equal to about 5.52 times the value R, the distance from point 3 to the x axis is equal to about 5.39 times the value R, and the distance from point 4 to the x axis is equal to about 5.62 times the value R.

8. The discharge plasma source of claim 1 wherein the channel of the back electrode is connected to a source of gas and the opening of the front electrode is positioned to receive radiation emitted from the proximal end of the capillary bore.

9. The discharge plasma source of claim 8 wherein the source of gas contains xenon.

10. The discharge plasma source of claim 1 wherein the source of electric potential establishes substantially uniform first electric fields along the inner surface of the front electrode and substantially uniform second electric fields along the inner surface of the back electrode.

11. The discharge plasma source of claim 1 wherein the front and back electrodes are made of tantalum.

12. The discharge plasma source of claim 1 wherein the body is made of boron nitride.

13. The discharge plasma source of claim 1 wherein the front electrode is grounded.

14. A method of producing extreme ultra-violet and soft x-ray radiation that comprises the steps of:

(a) providing an electric discharge plasma source that comprises:

(i) a body that defines a circular capillary bore that has a proximal end and a distal end;

(ii) a back electrode positioned around and adjacent to the distal end of the capillary bore wherein the back electrode has a channel that is in communication with the distal end and that is defined by a non-uniform inner surface which exhibits a first region which is convex, a second region which is concave, and a third region which is convex wherein the regions are viewed outwardly from the inner surface of the channel that is adjacent the distal end of the capillary bore so that the first region is closest to the distal end;

(iii) a front electrode positioned around and adjacent to the proximal end of the capillary bore wherein the front electrode has an opening that is communication with the proximal end and that is defined by a non-uniform inner surface which exhibits a first region which is convex, a second region which is substantially linear, and third region which is convex wherein the regions are viewed outwardly from the inner surface of the opening that is adjacent the proximal end of the capillary bore so that the first region is closest to the proximal end; and (iv) a source of electric potential that is connected across the front and back electrodes; and (v) a housing that defines a vacuum chamber that is in communication with the opening of the front electrode;

(b) introducing gas from a source of gas into the channel of the back electrode and into the capillary bore; and (c) causing an electric discharge in the capillary bore sufficient to create a plasma within the capillary bore thereby producing radiation of a selected wavelength.

15. The method of claim 14 wherein the gas is xenon.

16. The method of claim 14 wherein the pressure within the vacuum chamber during step (c) is less than about $1\times10^{-3}$ Torr.

17. The method of claim 14 wherein step (c) creates a 20 to 50 eV plasma.

18. The method of claim 14 wherein step (c) comprises causing a pulse electric discharge for between about 0.5 to 4 micro-seconds.

19. The method of claim 14 wherein the capillary bore has a length L as measured from the proximal end to the distal end along a central x axis and wherein the position of the capillary bore at the distal end is designated position zero of the x axis and the positions of the first, second, and third regions of the inner surface of the back electrode are defined by points 1, 2, 3 and 4 along the x axis wherein point 1 is substantially coincidental to zero, point 2 is equal to about 0.06 of the value of L, and point 3 is equal to about 0.47 of the value of L, and point 4 is equal to about 0.93 of the value of L with the first region being situated between points 1 and 2, the second region being situated between points 2 and 3, and the third region being situated between points 3 and 4.

20. The method of claim 19 wherein the inner surface of the back electrode further exhibits a fourth region that is substantially linear and parallel to the x axis and that extends beyond point 4 for a length equal to at least about 0.2 of the value L.

21. The method of claim 19 wherein the capillary bore has a radius R as measured from the center of the capillary bore along a y axis and wherein the position of the capillary bore at the center is designated position zero of the y axis and the positions of points 1, 2, 3, and 4 of the inner surface of the back electrode as measured along the y axis are such that the distance from point 1 to the x axis is equal to about 6.0 times the value R, the distance from point 2 to the x axis is equal to about 5.35 times the value R, the distance from point 3 to the x axis is equal to about 3.70 times the value R, and the distance from point 4 to the x axis is equal to about 1.82 times the value R.

22. The method of claim 14 wherein the capillary bore has a length L as measured from the proximal end to the distal end along a central x axis and wherein the position of the capillary bore at the distal end is designated position zero of the x axis and the proximal end is designated −L and the positions of the first, second, and third regions of the inner surface of the front electrode are defined by points 1, 2, 3 and 4 along the x axis wherein point 1 is substantially coincidental to −L, point 2 is equal to about 1.075 of the value −L, and point 3 is equal to about 1.25 of the value −L, and point 4 is equal to about 1.34 of the value −L with the first region being situated between points 1 and 2, the second region being situated between points 2 and 3, and the third region being situated between points 3 and 4.

23. The method of claim 22 wherein the inner surface of the front electrode further exhibits a fourth region that is substantially linear and defines an angle of about 60 degrees relative to the x axis and that extends beyond point 4 to a point at least equal to about 1.5 of the value −L.

24. The method of claim 22 wherein the capillary bore has a radius R as measured from the center of the capillary bore along a y axis and wherein the position of the capillary bore at the center is designated position zero of the y axis and the positions of points 1, 2, 3, and 4 of the front electrode as measured along the y axis are such that the distance from point 1 to the x axis is equal to about 6.18 times the value R. the distance from point 2 to the x axis is equal to about 5.52 times the value R, the distance from point 3 to the x axis is equal to about 5.39 times the value R, and the distance from point 4 to the x axis is equal to about 5.62 times the value R.

25. The method of claim 14 wherein the channel of the back electrode is connected to the source of gas and the opening of the front electrode is positioned to receive radiation emitted from the proximal end of the capillary bore.

26. The method of claim 14 wherein the source of electric potential establishes substantially uniform first electric fields along the inner surface of the front electrode and substantially uniform second electric fields along the inner surface of the back electrode.

27. The method of claim 14 wherein the front and back electrodes are made of tantalum.

28. The method of claim 14 wherein the body is made of boron nitride.

29. The method of claim 14 wherein the front electrode is grounded.

* * * * *